US006915903B2

(12) United States Patent
Manuel et al.

(10) Patent No.: US 6,915,903 B2
(45) Date of Patent: Jul. 12, 2005

(54) REINFORCED PACKAGING SYSTEM

(75) Inventors: James E. Manuel, Austin, TX (US); John W. Bridges, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 52 days.

(21) Appl. No.: 10/437,114

(22) Filed: May 13, 2003

(65) Prior Publication Data

US 2004/0226851 A1 Nov. 18, 2004

(51) Int. Cl.[7] ..... B65D 81/113; B65D 85/30
(52) U.S. Cl. ..... 206/523; 206/320
(58) Field of Search ..... 206/305, 320, 206/523; 428/36.5

(56) References Cited

U.S. PATENT DOCUMENTS 3,181,693 A * 5/1965 Freistat ..... 206/523
4,009,781 A * 3/1977 Agnew et al. ..... 206/307.1
4,413,735 A * 11/1983 Little ..... 206/523
4,576,846 A * 3/1986 Noel ..... 428/36.5
5,040,678 A * 8/1991 Lenmark et al. ..... 206/443
5,522,539 A * 6/1996 Bazany ..... 229/139
5,855,275 A 1/1999 Hunter et al. ..... 206/429
5,879,769 A 3/1999 Greenland et al. ..... 428/35.7
6,012,266 A 1/2000 Koskinen et al. ..... 53/399
6,082,543 A * 7/2000 Beliveau ..... 206/523
6,205,750 B1 3/2001 Koskinen et al. ..... 53/449
6,250,049 B1 6/2001 Feldman et al. ..... 53/452
6,274,217 B1 * 8/2001 Kim ..... 428/131

* cited by examiner

*Primary Examiner*—John A. Ricci
(74) *Attorney, Agent, or Firm*—Baker Botts L.L.P.

(57) ABSTRACT

A reinforced packaging system is provided that includes a slit and an insert at a location in the foam frame that is susceptible to puncture. The presence of the slit and insert provides localized support against puncture by the shipped unit or an external component of the shipped unit. The insert may be composed of a paper, plastic, or other suitable product that is able to absorb the force from the shipped unit and transfer this force across the insert and the adjacent foam.

20 Claims, 3 Drawing Sheets

REINFORCED PACKAGING SYSTEM

TECHNICAL FIELD

The present disclosure relates generally to the field of packaging, and, more particularly, to a reinforced packaging technique for the shipment of computer systems and other products.

BACKGROUND

Computer systems, as well as other products, are shipped worldwide to customers. These products must be packaged in a manner that ensures that the products reach their destination without being damaged during the shipping process. Typically, the unit is enclosed for shipment within a protective foam frame. Once the unit is placed within the protective foam frame, the foam frame is slid into a cardboard box for shipment. The foam frame cushions the unit against the customary movement and jostling that is typical in the shipping process.

In the computer industry, the physical size of many computer systems is decreasing. In particular, many server systems are becoming thinner. Despite this decrease in physical size, the feature set of many computer systems continues to grow in complexity. As an example, a server system may have a size of 1U (1¾" of thickness) and include within the case dual processors, multiple hard drives, and a backup power system. The placement of these features within a single server system leads to an increase in component density within the server unit. In addition, some server systems included parts that protrude externally from the chassis of the server system. As an example, some server systems may include an external power dongle or mounting flanges that are external to the chassis of the computer system. If a unit that includes an external component is dropped, depending on the angle of the drop and the shape of the external component, the external component may cut through the protective foam frame. If this occurs, the external component may encounter a hard stop once the external component reaches a hard surface, damaging the external component or the entire unit. The possibility of the unit cutting through the foam is exacerbated when the unit itself is heavy, as in the case of some server units. In the case of server units, protecting the server unit from damage is critical, as the server unit is often a vital piece of a computer network, as compared with a desktop or client computer.

SUMMARY

In accordance with the present disclosure, a packaging system is provided that includes a foam frame. Within the foam frame, at a location that is susceptible to puncture, is a slit and an insert within the slit. The insert may be composed of a paper or plastic material. The insert cushions the shipped unit against a hard stop by preventing the shipped unit from puncturing through the foam frame. When the shipped unit contacts the insert, the insert transfers the force of the shipped unit across the surface area of the insert, which in turn transfers this force across the adjacent foam, preventing the unit from puncturing through the foam.

A technical advantage of the present disclosure is the structure of the disclosed packaging system, which provides a solution that can be localized to the weakest points of the foam frame. As such, it is not necessary to have an insert throughout the entire foam frame. Instead, the insert is placed in only those locations that are known, whether through testing or otherwise, to be the most susceptible to puncture by the shipped unit. Another technical advantage of the present invention is a packaging system that prevents damage to the shipped unit without increasing the cost or shipping weight of the package. Because the insert is placed in the area or areas that are the most susceptible to puncture, the cost and weight of the packaging system is not significantly increased. Other technical advantages will be apparent to those of ordinary skill in the art in view of the following specification, claims, and drawings.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
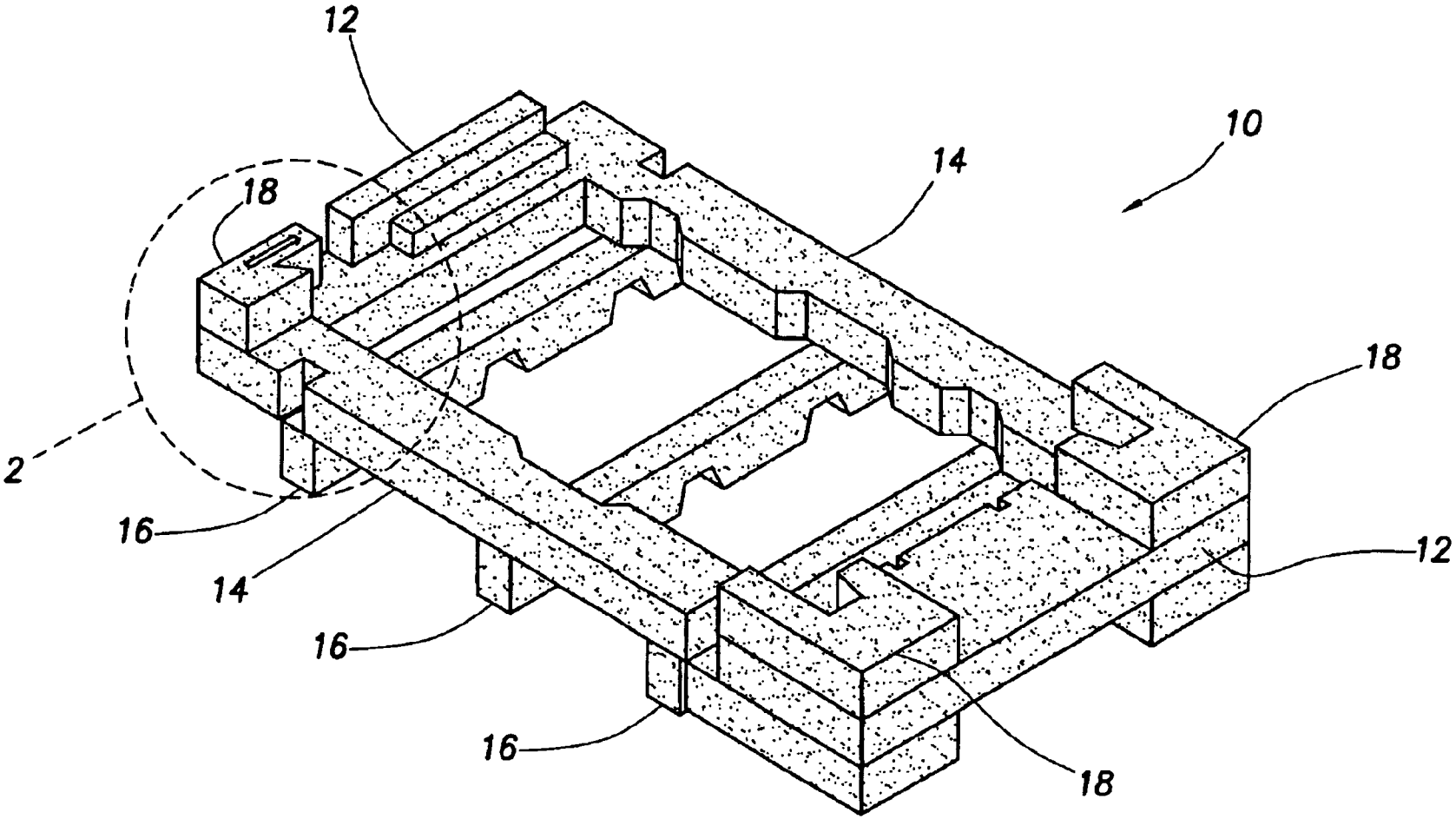
FIG. 1 is a pictorial view of a foam frame.

The present disclosure concerns a foam frame for the packaging of computer systems, including server computer systems, and other products. Shown generally at 10 in FIG. 1 is a foam frame of a packaging system. The dimensions, features, and shape of foam frame 10 are sized and selected to accommodate a particular product. In the example of FIG. 1, the dimensions features, and shape of foam frame 10 are set to accommodate a server computer system. Foam frame 10 includes end supports 12, side supports 14, and slat supports 16. Foam frame 10 also includes three elevated corner pieces 18. Elevated corner pieces 18 include a foam corner that is elevated above the adjacent end support 14 and side support 16 for better support of the unit included within the foam frame.

Figure 2:
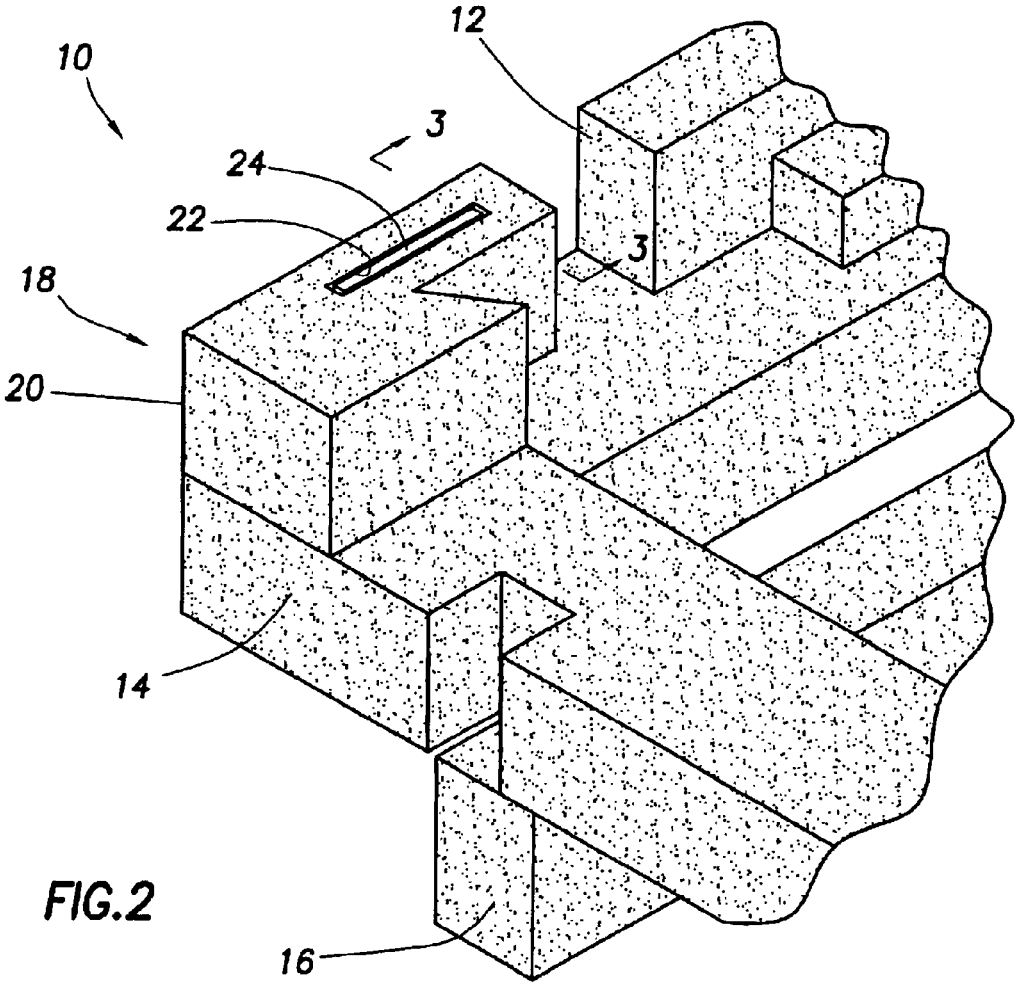
FIG. 2 is a pictorial view of a corner support of the foam frame of FIG. 1.
Figure 3:
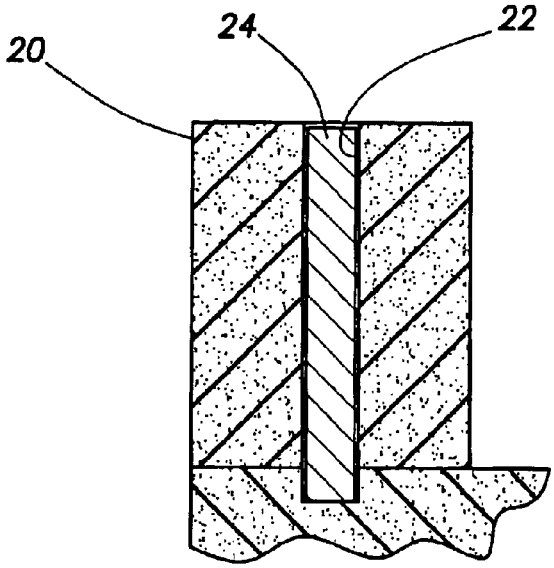
FIG. 3 is a cross-sectional view of the corner support of FIG. 2, taken along the line 3—3 of FIG. 2.

Shown generally in FIG. 2 is a detailed view of corner piece 18 that is shown by the dotted lines at 2 in FIG. 1. Corner 18 of FIG. 2 includes end support 12, side support 14, and a corner support 20. Corner support 20 includes a slit 22 that runs parallel to end support 12. Within slit 22 is an insert 24. Insert 24 is placed within foam frame 10 at a single location or multiple locations that correspond to the weakest points of the foam frame, including those areas of the foam frame that are most likely to be punctured by an external part on the unit being shipped. As shown in FIG. 2, slit 22 and insert 24 are positioned within corner support 20 such that there is a significant foam thickness on both sides of slit 22. As shown in FIG. 2, slit 22 and accompanying insert 24 are positioned such that there is a substantial thickness of foam interior to insert 24 (i.e., toward the center of foam frame 10) and to the exterior of foam frame 24. FIG. 3 is a cross-sectional view of corner piece 18 of FIG. 2 taken along the line 3—3 of FIG. 2. Shown in FIG. 3 is slit 22 within corner support 20. Included within slit 22 is insert 24. As shown in FIG. 3, slit 22 and insert 24 may extend through corner support 20 and terminate in an end support member.

In the event that the shipped unit is dropped such that the shipped unit or an external component of the shipped unit contacts insert 24, insert 24 will flex and will disperse the force upon insert 24 across the surface of insert 24 and across the foam that is behind insert 24. The ability of insert 24 to deform and spread the impact of the unit across insert 24 and the foam behind insert 24 decelerates the shipped unit and prevents a hard stop of the shipped unit against a hard surface. Insert 24 is sufficiently pliable that contact between the unit and insert 24 does not harm the unit or the surrounding foam. Insert 24 may, for example, be made of corrugated cardboard or a deformable plastic.

Figure 4:
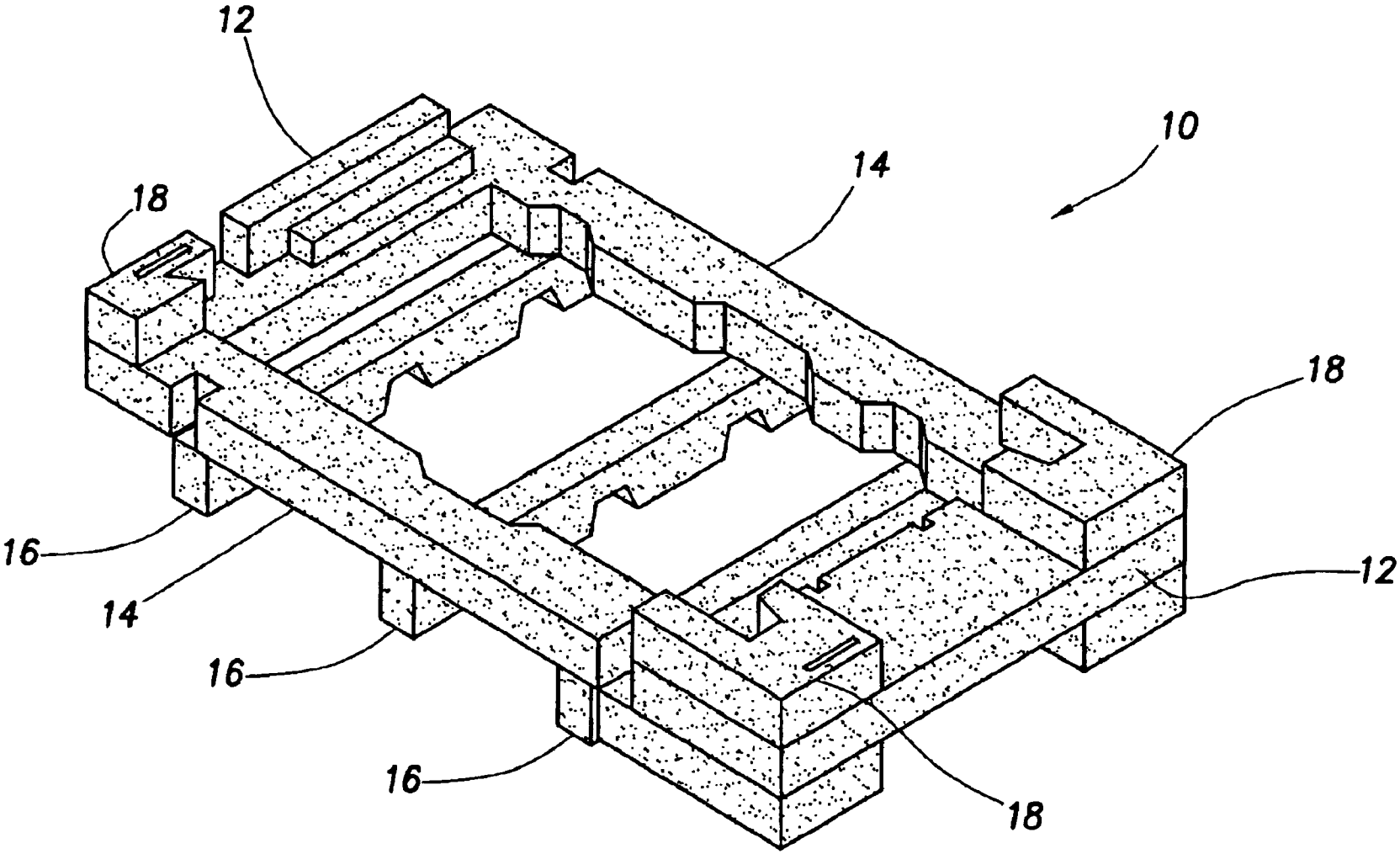
FIG. 4 is a pictorial view of a foam frame having a plurality of slits.

More than one slit 22 and accompanying insert 24 can be used in a single foam frame 10. FIG. 4 illustrates one embodiment of a foam frame having plurality of slits. The slit and an accompanying insert can be placed in all those locations of the foam frame in which the foam frame will encounter extraordinary stresses or the possibility of puncture because of the shape of the unit being shipped, including the shape of any external components on the unit being shipped. As such, the use of the slit and an accompanying insert can be localized to the weakest points of the foam frame. As compared with the option of having a reinforcing insert throughout the entire foam frame, the use of a slit and insert in only those areas in which the foam frame is the most vulnerable reduces the cost and weight of the foam frame. As such, because the weight of the foam frame is not markedly increased, the shipping weight, and therefore the shipping cost, of the unit is not markedly increased by the presence of one or more slits and accompanying inserts.

It should be recognized that the technique described herein may be used with foam frame of any size and shape, and the use of the technique described herein is not dependent on the presence of a foam frame having a certain size or configuration. Although the present disclosure has been described in detail, it should be understood that various changes, substitutions, and alterations can be made hereto without departing from the spirit and the scope of the invention as defined by the appended claims.

What is claimed is:

1. A packaging system, comprising:

a foam frame sized to receive an object, wherein the foam frame has a slit therein that is sized to receive an insert, and wherein at least a portion of the foam frame exists between the object and the slit; and an insert positioned within the slit.

2. The packaging system of claim 1, wherein the slit and the associated insert are positioned at a location that is prone to puncture.

3. The packaging system of claim 1, wherein the insert is comprised of a paper.

4. The packaging system of claim 3, wherein the insert is comprised of corrugated cardboard.

5. The packaging system of claim 1, wherein the insert is comprised of a plastic.

6. The packaging system of claim 1, wherein the slit and the associated insert are positioned proximate a corner of the foam frame.

7. The packaging system of claim 6, wherein the foam frame includes an elevated corner piece; and wherein the slit and the associated insert are within the corner piece.

8. The packaging system of claim 1, wherein the slit and the associated insert are positioned such that there is a substantial amount of foam thickness interior to and exterior to the insert.

9. A packaging system, comprising:

a foam frame sized to receive an object, wherein the foam frame has a plurality of slits therein sized to receive an associated insert, and wherein at least a portion of the foam frame exists between the object and the slit; and an insert positioned within each of the plurality of slits.

10. The packaging system of claim 9, wherein each of the plurality of slits and their respective inserts are positioned at a location that is prone to puncture.

11. The packaging system of claim 9, wherein at least one of the inserts is comprised of a paper.

12. The packaging system of claim 11, wherein at least one of the inserts is comprised of corrugated cardboard.

13. The packaging system of claim 9, wherein at least one of the inserts is comprised of a plastic.

14. The packaging system of claim 9, wherein at least one of the slits and its associated inserts are positioned proximate a corner of the foam frame.

15. The packaging system of claim 14, wherein the foam frame includes an elevated corner piece; and wherein at least one of the slits and its associated corner piece are positioned within the corner piece.

16. The packaging system of claim 9, wherein each slit and its associated insert are positioned such that there is a substantial amount of foam thickness interior to and exterior to the insert.

17. A packaging system, comprising:

a foam frame sized to receive an object, wherein the foam frame has a slit therein that is sized to receive an insert, and wherein at least a portion of the foam frame exists between the object and the slit; and a paper insert within the slit;

wherein the slit and the associated insert are at a location in the foam frame that is susceptible to puncture.

18. The packaging system of claim 17, wherein the insert is comprised of corrugated cardboard.

19. The packaging system of claim 17, wherein the slit and the associated insert are proximate a corner of the foam frame.

20. The packaging system of claim 17, wherein the foam frame includes an elevated corner piece; and wherein the slit and the associated insert are within the corner piece.

* * * * *